United States Patent [19]

Olesak et al.

[11] Patent Number: 4,810,991

[45] Date of Patent: Mar. 7, 1989

[54] ENCAPSULATED INTEGRAL FUSE BLOCK TRANSFORMER

[75] Inventors: John Olesak; Dennis D. Bonkrud, both of Elkhorn; Richard De Lain, Waukesha; William W. Barnes, II, Waterford, all of Wis.

[73] Assignee: General Signal Corporation, Stamford, Conn.

[21] Appl. No.: 100,808

[22] Filed: Sep. 24, 1987

[51] Int. Cl.[4] ..... H01F 27/04; H01F 15/10

[52] U.S. Cl. ..... 336/96; 336/107; 336/147; 336/192; 361/41

[58] Field of Search ..... 361/38, 39, 41; 336/105, 107, 192, 96, 65, 145, 146, 147

[56] References Cited

U.S. PATENT DOCUMENTS

| | | | |
|---|---|---|---|
| 3,479,563 | 11/1969 | Roy | 361/41 |
| 3,516,040 | 6/1970 | Ripley et al. | 336/96 |
| 3,728,656 | 4/1973 | Neuber | 336/192 X |
| 4,171,863 | 10/1979 | Perkins, Jr. | 336/96 X |
| 4,602,235 | 7/1986 | Howard et al. | 336/192 |

*Primary Examiner*—Thomas J. Kozma

*Attorney, Agent, or Firm*—Ronald Reichman; Robert S. Smith

[57] ABSTRACT

An assembly which includes a transformer having a primary winding, a secondary winding, wires extending from the windings, a core at least partially disposed within the windings, a mounting flange, a housing surrounding at least a part of the windings and apparatus for mounting a fuse block on the transformer. The apparatus for mounting includes a tongue extending within the housing and a potting compound disposed in the housing.

15 Claims, 2 Drawing Sheets

ENCAPSULATED INTEGRAL FUSE BLOCK TRANSFORMER

BACKGROUND OF THE INVENTION

The invention relates to transformers and particularly transformers and fuse blocks used in apparatus for supplying power to electric motor controls, hydraulic controls and pneumatic controls. Manufacturers of panel boards that include such apparatus must consider the labor required to assemble the panel, the space available on the panel, and the reliability of the equipment utilized.

Traditionally, fuse blocks and transformers have been individually mounted on such panels. These mounting arrangements utilize a substantial amount of panel space and result in the firm assembling the panel spending a substantial amount for assembly labor. In addition, the wires intermediate the transformer and the fuse block are exposed to damage due to negligence and thus may result in failure of the control system.

It is an object of the present invention to provide an assembly that occupies less space on the panel than traditional arrangements.

It is another object of the invention to assist the firm assembling the panel boards or the control panels by providing apparatus which requires less time to assemble and require less labor expense. More specifically, it is an object that the panel manufacturer's cost and labor time be reduced by utilizing the economies of scale inherent in having a large number of such assemblies produced at a single location rather than the individual panel manufacturer installing and wiring a smaller number of individual transformers and fuse blocks.

It is yet another object of the invention to provide apparatus which will have wiring which is less vulnerable to damage and thus to provide an assembly that will have greater reliability.

SUMMARY OF THE INVENTION

It has now been found that these and other objects of the invention may be attained in an assembly which includes a transformer having a primary winding, a secondary winding, wires extending from the windings, a core at least partially disposed within the windings, a mounting flange and a housing surrounding at least a part of the windings, and means for mounting a fuse block on the transformer. The means for mounting includes a tongue extending within the housing and a potting compound disposed in the housing. The apparatus also includes a fuse block having at least one fuse holder.

This embodiment of the apparatus in accordance with the invention may further include dimensioning the primary and secondary winding and the core to allow passage of the tongue intermediate (1) the primary and secondary windings and (2) the core. The tongue may be generally planar and a plurality of barriers may be disposed on the tongue for guiding and protecting wires extending from the transformer. In some forms of the invention the barriers may be each generally planar and substantially mutually parallel.

In various forms of the invention the barriers are each substantially perpendicular to the tongue and the means for mounting includes a base having a plurality of first channels in a first face thereof for guiding the wires from the transformer. Each of the first channels may be disposed in aligned relationship with a space intermediate at least two of the barriers and the barriers may be at least partially disposed in the potting compound in the housing. The fuse block may include at least a first spring member for engagement with the base and the base may include at least a first raised surface thereon for engagement with the first spring member. The fuse block may also include a second spring member and the base may include a second raised surface disposed for engagement with the second spring member. The spring members on the fuse holder may be disposed on opposed sides thereof. Each of the spring members may be an integrally molded part of the fuse holder. The fuse holder may include at least one U-shaped jumper and a plurality of connectors for engagement with the jumper. The fuse block may include at least three fuse holders. The base may include a plurality of second channels in a second face of the base. The first and second faces of the base may be opposed faces.

BRIEF DESCRIPTION OF THE DRAWING

The invention will be better understood by reference to the accompanying drawing in which.

DESCRIPTION OF THE PREFERRED EMBODIMENT

Figure 3:
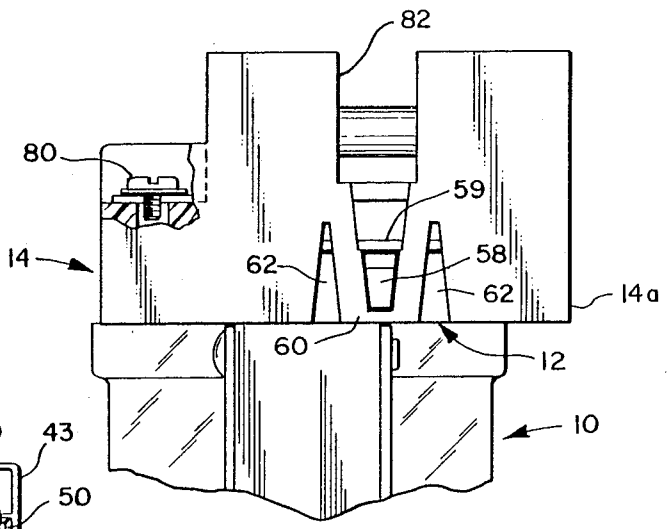
FIG. 3 is a right side elevational view the transformer and base after the fuse block in accordance with the invention has been installed on the base.
Figure 1:
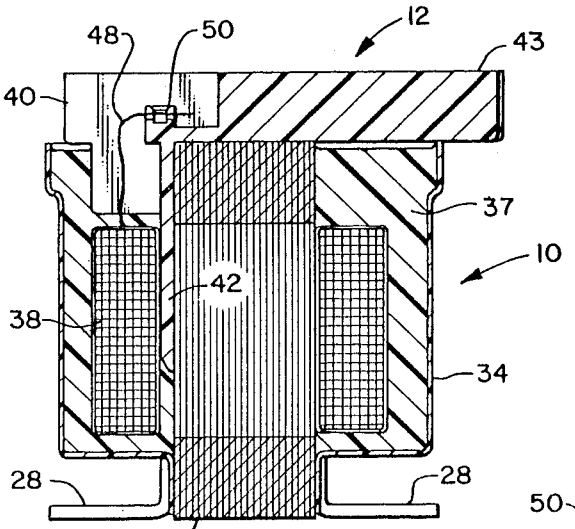
FIG. 1 is a sectional view of the transformer and base in accordance with a preferred form of the invention.
Figure 4:
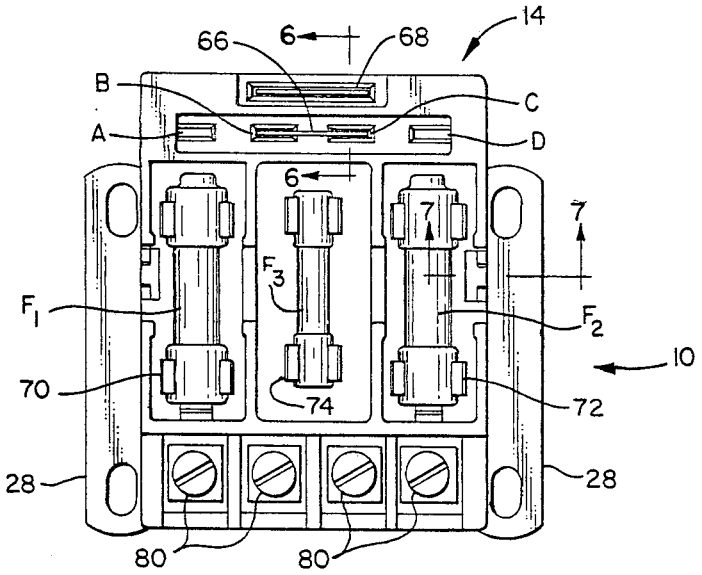
FIG. 4 is a top view of the assembly of the fuse block, base, and the transformer.
Figure 5:
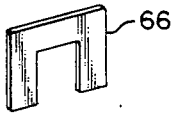
FIG. 5 is a perspective view of a jumper that cooperates with the fuse block to vary the operating range of the transformer.
Figure 6:
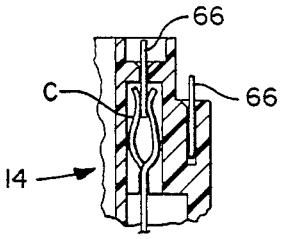
FIG. 6 is a broken away sectional view, taken along the line 6—6 of FIG. 4, of a portion of a fuse block which illustrates the manner of engagement of the jumper with a contact of the fuse block.
Figure 7:
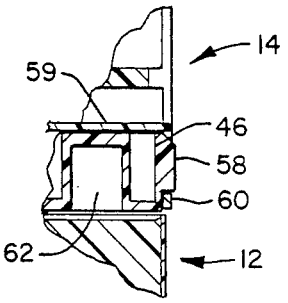
FIG. 7 is a fragmentary sectional view, taken along the line 7—7 of FIG. 4, illustrating the manner of engagement between the base and the fuse block.
Figure 8:
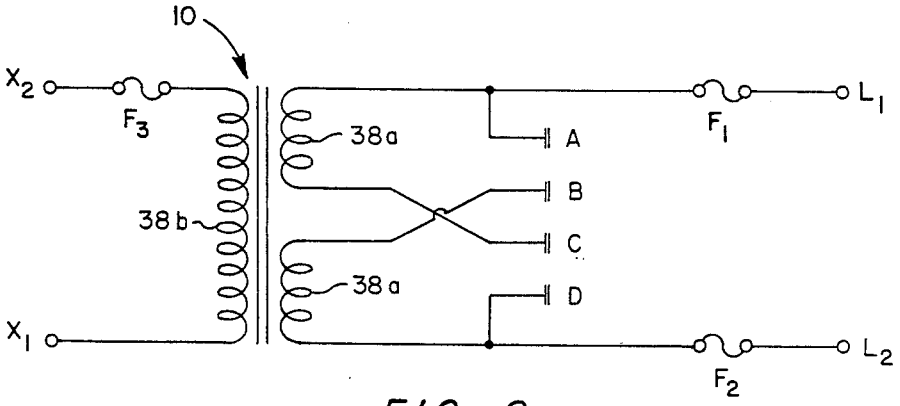
FIG. 8 is an electrical schematic diagram of the transformer and fuse block in accordance with the preferred form of the invention.

Referring now to FIGS. 1–8 there is shown a transformer 10, a base 12 and a fuse block 14. FIGS. 1 and 8 show the elements of the transformer 10: core 36 and a secondary winding **38*b* and two primary windings 38*a*. For simplicity, these three windings will be referred to collectively as windings 38. In other embodiments a transformer 10 may be provided with a single primary winding (not shown) or other variations. It will be seen from FIGS. 1 and 2 that the windings 38 are terminated by commercially available connectors 50 sold under the trademark MAG-MATE manufactured by AMP Incorporated of Harrisburg, Pa. As best seen in FIGS. 4 and 6 the primary windings 38*a* are shown joined by a jumper 66. One manner of installation of the jumper 66 is illustrated in FIGS. 4 and 6 to join connectors, designated by the letters B and C, which has the effect of placing the primary windings 38*a*, 38*a* in series. For other line voltage conditions the jumper 66 may be installed between the connectors designated in FIG. 8 as A and B and between the contacts designated by the letters C and D. In accordance with the National Electrical Code each input to the transformer 10** is individually fused with fuses F1, F2 because each line voltage input is a so-called "hot" wire and the potential between them will, for many applications, be 480 volts.

The transformer 10, in accordance with the preferred embodiment, is particularly suited for operation with either 240 or 480 volts. It will be understood that in various other forms of the invention other voltages may be utilized. The secondary windings 38*b* will ordinarily be connected to a fuse F3. The mounting for the fuses F1, F2, F3 and the fuse block 14 are described hereafter with respect to the detailed description of the fuse block 14.

Figure 2:
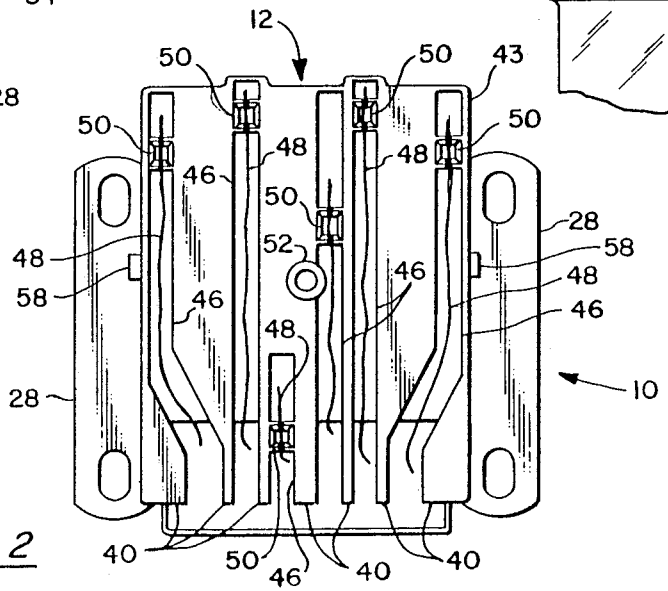
FIG. 2 is a top view of the apparatus illustrated in FIG. 1 that shows the mounting lugs for the transformer and the channels defined in the base for accommodating the magnet wires of the transformer.

Referring particularly now to FIGS. 1 and 2, the transformer 10 is provided with a preformed plastic end cap cover or housing 34 which covers the primary and secondary windings 38 and the magnet wires 48 that extend from the primary and secondary windings 38. After assembly of the transformer 10 and base 12 is complete, the cap 34 is filled with a plastic resin material or potting compound 37. In the preferred embodiment the potting compound 37 has two components, respectively identified as part A and part B (S7070), manufactured by Epic Resins, division of General Fiberglass Supply, Inc., 1421 Ellis Street, Waukesha, Wis. 53186) to encapsulate an axial portion of the magnet wires 48, partially as well as the primary and secondary windings 38. It will be further understood that when the potting compound 37 in the performed end cap 34 hardens the magnet wires 48 are secured intermediate the barriers 40 so that there is much less danger of breakage of the magnet wires 48 and thus the assembly will have a greater reliability than would be the case if individual components were mounted separately on a panel board. Stated another way, this encapsulation has the substantial advantage of preventing damage to the magnet wire 48 connections to the fuse block 14 and transformer 10 assembly both during installation and after installation. The transformer 10 is provided in a conventional manner with mounting lugs 28 or flanges and these mounting lugs 28 are used for mounting the entire assembly on a typical control panel (not shown) such as that used for control of electric motors, pneumatic equipment or hydraulic equipment.

The base 12 is ordinarily manufactured of a plastic material and is provided with a tongue 42 which is generally planar and extends along the side of the windings 38 of the transformer 10 where it is encased by the potting compound 37 within a molded preformed end cap or housing 34 surrounding the windings 38 of the transformer 10.

It will be understood that the potting compound 37 disposed within the cap or housing 34 surrounds the windings 38 of the transformer 10 and reduces the probability of injury to the relatively small magnet wires 48 extending from the windings 38 of the transformer 10. Thus, the potting compound 37 prevents damage due to mishandling of the assembly before installation as well as inadvertent damage to the magnet wires 48 when the transformer 10 is being installed on a control panel.

Ordinarily, a tongue 42 extends downwardly from the fuse block 14. The tongue 42 is generally planar and is disposed in face to face abutting relationship with the side of the core 36 of the transformer 10. The tongue 42 serves to locate or position the base 12. More specifically the tongue 42 fits intermediate the core 36 and the individual loops of the transformer 10 winding 38 the free end of the tongue 42 is bevelled for ease of installation. The base 12 is provided with opposed bosses 58 on opposed sides of the base 12.

Disposed along the outermost side face of the tongue 42 is plurality of barriers 40 which are each generally planar and disposed in substantially and mutually parallel relationship. More particularly, the barriers 40 are disposed in upstanding relationship to the tongue 42 and extend downward so that the lower most portion thereof is in close proximity to the core 36. The tongue 42 extends downwardly, as best seen in FIG. 1, from a generally parallelepiped shaped body 43. The tongue 42 extends approximately two thirds of the vertical height of the windings 38 of the transformer 10 and is disposed intermediate one side face of the core 36 and the inner face of the windings 38 as best seen in FIG. 1. It will also be seen from FIG. 1 that the major portion of the tongue 42 is disposed within the molded preformed end cap 34 that is filled with potting compound 37. It will also be apparent from FIG. 1 that the barriers 40 also extend into the potting compound 37 within the molded preformed end cap or housing 34. The body 43 of the base 12 has a plurality of channels 46 formed along the upper surface as been seen in FIG. 2. The channels 46 are partially defined by the barriers 40. Thus, magnet wires 48 may extend from the winding 38 intermediate the barriers 40 and thence into the channels 46. The magnet wires 48 are joined by the connectors 50 to elements of the fuse holders 70, 72, 74 carried on the plate 59. The body 43 is also provided with a locating boss 52 centrally disposed in the upper face, as best seen in FIG. 2, which cooperates with a suitably dimensioned recess (not shown) in the bottom of the fuse block 14.

The bottom of the fuse block 14 has a depending skirt 14a that covers the entire side of the base 12 when the two are assembled in normal fashion as best shown in FIG. 3. As shown also in FIG. 3, the bosses 58 are engaged by flexible clips 60 to latch the fuse box 14 and the base 12 together in substantially permanent relationship. Each clip 60 is formed in the plastic portions of the fuse block 14 by U-shaped openings 62. This allows the clip 60 to flex outwardly for assembly. This arrangement is further illustrated in FIG. 7 which also shows the relationship of the channel 46 to the bosses 58. This illustration also shows a channel 62 in the lower face of the generally parallel piped shaped body 43. This channel 62 is typical of various such channels 62 which is disposed intermediate and generally parallel to the channels 46 in the upper face of the body 43. The channel 62 serves to reduce the weight and cost of the body 43 and also serves to provide a substantially constant wall thickness to make this element easer to mold. The fuse block 14 includes a cut out 82 for more convenient access to the fuses F1, F2, F3 mounted therein.

The fuse block 14 upper face, as best seen in FIG. 4, includes connectors A, B, C, D which are illustrated in the electrical schematic of FIG. 8. A slot 68 is provided in the fuse block 14 for holding a jumper 66 when it is not in use. The fuse block 14 is provided, in the preferred embodiment, with three fuse holders 70, 72 and 74 that respectively hold fuses, F1, F2 and F3. Fuses F1 and F2 are provided with one axial extremity which is of a smaller diameter than the adjacent axial extent. These fuses F1 and F2 are known as type CC fuses. Each has one pole designed to be installed in a fuse holder which will only accept fuses of this type and will reject any attempt to install a more conventional fuse. The fuses F1, F2 are provided to fuse the line voltage supply to the primary of the transformer terminals 80 provided for connection of the line voltage and load to the assembly. The fuse holders 70, 72, 74 and terminals 80 are carried on a plate 49 which is part of the fuse block 14. More specifically, the plastic plate 59 snaps into the rest of the plastic fuse block. It will be seen that the apparatus in accordance with the invention enables the panel manufacturer to advantageously utilize the economies of scale by purchasing such assemblies and that such assemblies will have greater reliability, in part, because of reduced danger of damage to the magnet wires 48. In addition, the conventional or normal way of using lead wires connected to the magnet wires 48 by wire lugs and terminal strips is time consuming and the present invention eliminates such arrangements. The invention has been described with reference to its illustrated preferred embodiment. Persons skilled in the art may upon exposure to the teachings herein, conceive other variations. Such variations are deemed to be encompassed by the disclosure, the invention being delimited only by the appended claims.

Having thus described our invention we claim:

1. An apparatus which comprises:

a fuse block having at least one fuse holder;

a transformer which includes a primary winding, a secondary winding, a plurality of wires extending from said windings, a core at least partially disposed within said windings, a mounting flange and a housing surrounding at least a part of said windings; and means for mounting said fuse block on said transformer, said means for mounting including a tongue extending within said housing and a potting compound disposed in said housing, said primary and secondary windings and said core being dimensioned to allow passage of said tongue intermediate said primary and secondary windings and said core.

2. The apparatus as described in claim 1 wherein:

said tongue is generally planar and a plurality of barriers are disposed on at least a part of said tongue for guiding and protecting said plurality of wires extending from said windings.

3. The apparatus as described in claim 2 wherein:

said barriers are each generally planar.

4. The apparatus as described in claim 3 wherein:

said barriers are substantially mutually parallel.

5. The apparatus as described in claim 4 wherein:

said barriers are each substantially perpendicular to said tongue.

6. The apparatus as described in claim 5 wherein:

said means for mounting includes a base having a plurality of first channels in a first face thereof for guiding, and protecting said plurality of wires extending from said windings.

7. The apparatus as described in claim 6 wherein:

each of said first channels is disposed in aligned relationship with a space intermediate at least two of said barriers.

8. The apparatus as described in claim 7 wherein:

said barriers are at least partially disposed in said potting compound in said housing.

9. The apparatus as described in claim 8 wherein:

said fuse block includes at least a first spring member for engagement with said base. engagement with said base.

10. The apparatus as described in claim 9 wherein:

said base includes at least a first raised surface thereon for engagement with said first spring member.

11. The apparatus as described in claim 10 wherein:

said fuse block includes a second spring member and said base includes a second raised surface disposed for engagement with said second spring member.

12. The apparatus as described in claim 11 wherein:

said spring members on said fuse holder are disposed on opposed sides thereof.

13. The apparatus as described in claim 12 wherein:

each of said spring members is an integrally molded part of said fuse holder.

14. The apparatus as described in claim 13 wherein:

said base includes a plurality of second channels in a second face of said base.

15. The apparatus as described in claim 14 wherein:

said first and second faces of said base are opposed faces.

* * * * *